US007484863B1

(12) United States Patent
Aubrey

(10) Patent No.: US 7,484,863 B1
(45) Date of Patent: Feb. 3, 2009

(54) LIGHTING FIXTURE

(76) Inventor: Truman Aubrey, 1472 Beaudry Blvd., Glendale, CA (US) 91208

( * ) Notice: Subject to any disclaimer, the term of this patent is extended or adjusted under 35 U.S.C. 154(b) by 103 days.

(21) Appl. No.: 11/599,710

(22) Filed: Nov. 16, 2006

(51) Int. Cl.
*F21V 29/00* (2006.01)

(52) U.S. Cl. ..... 362/294; 362/480; 362/373

(58) Field of Classification Search ..... 362/294, 362/373, 480, 264, 147
See application file for complete search history.

(56) References Cited

U.S. PATENT DOCUMENTS 182,855 A * 10/1876 Ruhlmann ..... 248/286.1
2,131,054 A * 9/1938 Kurth ..... 362/294
3,116,022 A * 12/1963 Davis ..... 362/294
4,120,023 A * 10/1978 McReynolds, Jr. ..... 362/16
4,281,370 A * 7/1981 Masenheimer et al. ..... 362/287
4,841,422 A * 6/1989 Groh ..... 362/294
5,134,554 A * 7/1992 Donato et al. ..... 362/651
6,764,211 B2 * 7/2004 Eto et al. ..... 362/547
6,896,392 B2 * 5/2005 Jigamian et al. ..... 362/202
2003/0179589 A1 * 9/2003 Eto et al. ..... 362/547

* cited by examiner

*Primary Examiner*—Ali Alavi
(74) *Attorney, Agent, or Firm*—G. Donald Weber, Jr.

(57) ABSTRACT

The invention features an improved lighting fixture structure with temperature control and stray light reductions, together with a unique directional pivot/extension mounting mechanism.

18 Claims, 4 Drawing Sheets

LIGHTING FIXTURE

BACKGROUND OF THE INVENTION

1. Field of the Invention

This invention is directed to lighting fixtures, in general, and to lighting fixtures which provide reduction of temperature, reduction of unwanted glare from side light loss and, as well, can use directional extension mounting mechanisms while using CMH or similar lamps, in particular.

2. Prior Art

There are many light fixtures known in the art which can be classified into a number of categories such as track lighting, recessed down lights and the like. The broadest category is decorative fixtures, such as ceiling and surface mounted fixtures, wall mounted fixtures, pendant mounted fixtures and the like. Many of these fixtures permit replacement of conventional incandescent lamps.

In addition, there are many types of reflective glass covers known in the art. These covers typically include an aluminized glass reflector, support necks attached thereto, and appropriate threaded collars for mounting the reflectors over the light source, also referred to as a lamp. However, these reflectors are often limited in terms of size and utility by the fixture in which the reflector is mounted.

In retail spaces, the goal is, generally, to draw the customer's attention to the merchandise being displayed, not to the lighting fixtures. In down light applications, the elimination of stray light lamp imaging and light glare reflection off the inside the reflector/trim assembly is extremely important. Even small amounts of radiant side light, from the edges of the screw-based reflector lamps, is undesirable.

The aesthetic lighting design principles are virtually the same for new construction and/or retrofit application.

It is also useful to understand the evolution of energy efficient retrofit lighting over the past number of years, and to reflect on the changes that have taken place as new lighting technologies have been introduce into the market place.

U.S. Pat. No. 5,073,845 (Aubrey) illustrates a socket assembly used with a one piece aluminized glass reflector. This glass reflector lens, commonly used in the lamp industry to manufacture incandescent light bulbs (R30, R40, PAR-38 reflector flood and spot lights are examples) are fitted with threaded aluminum collars and modified to accept a single-ended compact fluorescent lamp or HID screw-base lamp as a retrofit for an existing incandescent fixture. However, objectionable side glare off the edges of the front lens was an unwanted by product of this design.

Adapter socket cup housings were made of formed aluminum for these situations. Within the cup was a fluorescent lamp holder designed to accept a compact, single-ended, two-pin low-wattage lamp or, alternatively, a female screw-based lamp holder to accept Edison-based high pressure sodium (HPS) screw-base lamps. The cosmetic appearance of not seeing the fluorescent or HPS lamp is desirable. However, considerable heat is generated by these lamps. Also, the one piece glass reflector trapped heat around the lamp tubes, causing the lamp bulb wall temperature to run higher than in an open reflector. To resolve these problems, ventilation holes were provided in the bottom of the socket cup. This solution, however, resulted in unwanted "light leak" out the back of the assembly. Even though unwanted light leak was produced, because of holes in the bottom of the socket cup, the ventilation holes were necessary to cool the adaptors.

With the advent of higher wattage (26/32 watt) compact fluorescent lamps, it was found that a substantial amount of heat was generated but not dissipated adequately via the aluminum structure and vent holes in the socket cup assembly to make the adaptor function properly. Therefore, an aluminum heat sink with a plurality of fins was developed as described in U.S. Pat. No. 6,974,233 (Aubrey).

Recently, lamp manufacturers have introduced highly efficient (64 lumens per watt) one-piece PAR 38 metal halide lamps. Over the last few years smaller size PAR lamps have been introduced and CMH lamps have become very popular.

Small tubular shaped, single ended "T-CMH" (ceramic metal halide) lamps have been recently introduced into the market place. These lamps are arch-tubes shielded within a tubular clear glass envelope and are simply the light producing element that, historically, has been molded into the glass PAR reflector/lens configurations during the manufacturing process that is used to produce Edison screw based lamps. In other words, these are bare tube metal halide lamps, without a reflector and without an Edison screw base attachment. In place of the traditional Edison screw-shell base attachments, specific pin coupling lamp bases have been incorporated.

The "T-CMH" lamps have been relatively slow to gain acceptance with fixture manufacturers and end-user customers. To change the lamp in a small fixture, one must be able to grasp the relatively small diameter lamp with two fingers and either pull or twist it to remove it from the socket/reflector assembly contained with in the fixture.

Since fixtures have, typically, been designed to accept off-the-shelf, one-piece, screw-in light bulbs, with Edison screw-base, lighting element, reflector and lens as an integral product, there is a limit as to how small the fixture lens opening or depth of recess can be and still allow one to easily change the lamp that is contained within the fixture.

Of additional concern, as fixtures have become smaller and smaller, unwanted excessive heat is usually generated and, of great importance, is the elimination of unwanted radiant side light. This unwanted light leak through ventilation holes in socket assembles or in other parts of the fixtures are byproducts of these openings in the fixtures that are necessary to ventilate the fixture and prevent overheating thereof.

Edison base screw-in PAR metal halide lamps are constructed as an integral unit, with an assembly of a parabolic reflector in a precise relationship to the arch tube. Even a slight variation in the positioning of the arch tube within the reflector assembly will greatly affect the maximum light efficiency of the light produced from the assembly.

Lamp manufacturers control the location of the arch-tube within a parabolic reflector in the manufacturing process by fusing the glass components together in the proper orientation to assure maximum light output.

Likewise, fixture manufactures, using the single ended CMH lamps, traditionally control the location of the arch-tube in relationship to a parabolic reflector by making the socket/parabolic assembly a one piece, unitized assembly, so that no variations will occur in the manufacturing process. The lamp holder structure, contained within the fixture typically has a parabolic reflector attached to it.

The above description outlines, briefly, the advances in light source (lamp) technology and the difficulties produced thereby.

SUMMARY OF THE INSTANT INVENTION

The subject invention comprises, basically, a three part assembly comprised of a heat dissipating, no light leak socket assembly, a separate detachable optical system containing a reflector and provisions for optional lens distributions, colors, textures, louvers and the like, and a bracket system to point, or direct the lighting element in the desired direction.

The socket assembly includes a housing with a suitable socket for mounting a lamp therein and which allows air ventilation therethrough. Air enters through slots at the top end of the socket assembly and exits through openings at the bottom of the socket assembly. The movement of air through the socket assembly cools the base portion of the lamp assembly and prevents overheating.

The socket assembly can also be fitted with a male Edison base screw shell to be screwed into a suitable female mating screw shell for use in fixtures that have been fitted with a ballast suitable to operate at the designated T-CMH lamp wattage.

The optical system includes a screw-on reflector assembly with a built-in glare shield (sometimes referred to as a "snoot, ") which can take the form of a reflective metal (or a metallized glass reflector) mounted within the glare shield. The shield is shaped or extruded and includes a threaded or twist lock connector which connects to a mating part on the socket assembly.

One or more circular grooves can be machined or die cast into the inner surface of the cylindrical shaped shield to act as an element holder. Alternatively, an optional element holder component can be removably inserted into the open end of a formed shield to removably insert optional color filters, louvers or the like. This separate unitized optic chamber attaches to the vented socket assembly, and is removable therefrom thereby exposing a lamp mounted in the assembly for easy lamp access during relamping.

Additional provisions are made for optional, field or factory installation of optical elements such as spot, flood, colored or specialty lenses or louvers, and the like to control the intensity and/or pattern of light produced by the integral reflector. The reflector can be removable or unitized as a permanent attachment contained within the reflector housing.

A pivot bracket mechanism, usually consisting of two or more jointed bracket members, can be fixed or rotational. The bracket members are U-shaped and provide directional aiming and/or extension of the light source either out of recessed fixtures or deeper up into the recessed fixture. The adjustable bracket is attached to the socket cup member that is threadedly attached to the shield and reflector with options contained therein.

The subject invention is especially suited for use in directional fixtures, down lights used for display or general illumination and track lighting fixtures that typically would be used for display lighting in retail spaces and is useful for new construction lighting or retrofit projects, because it saves energy and reduces maintenance costs.

Thus, the fixture described herein provides removal of unwanted heat from the fixture, prevents unwanted light leak in the socket area, eliminates glare or radiant light from the edges of PAR lamps in recessed reflector assemblies, and allows for easy lamp replacement.

The socket assembly and separate detachable optical chamber system provides a unitized structure assuring proper arch-tube, reflector orientation thereby achieving optimum light output. Any lenses, color filters, louver etc. are attached with spring clip or the like to the front of the optic chamber assembly as needed.

DESCRIPTION OF A PREFERRED EMBODIMENT

Figure 1:
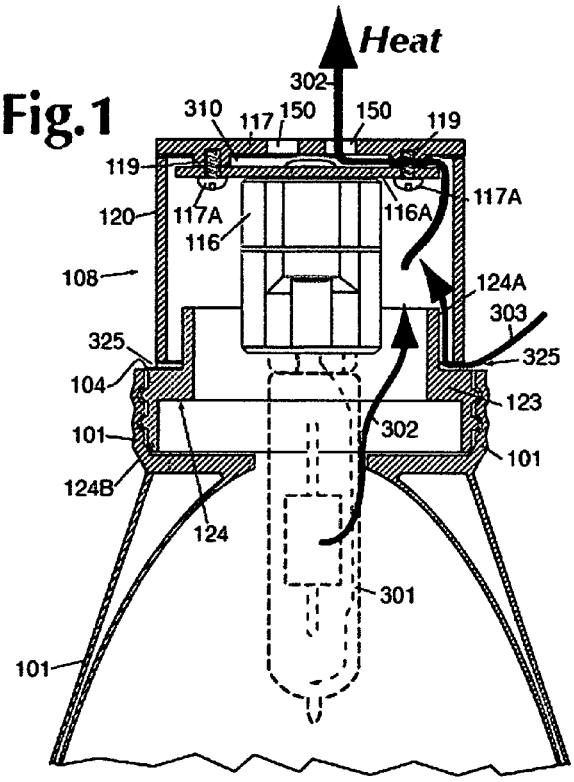
FIG. 1 is a cutaway view of one embodiment of a socket assembly with a representation of a lamp included therein.
Figure 3:
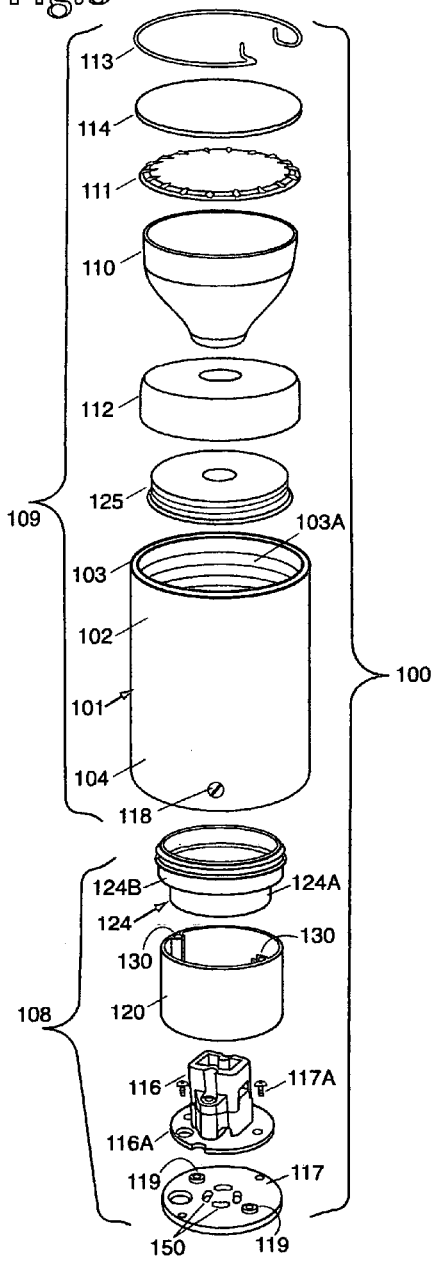
FIG. 3 is an exploded view of the socket assembly with an optical lighting chamber attached thereto.

Referring now to FIG. 1, there is shown a cutaway view of an assembled socket cup assembly 108 which is shown exploded in FIG. 3. A representative lamp 301 is depicted in dashed outline. This lamp design is not be limitative of the inventive concept described herein.

The assembly 108 includes a lamp holder 116 of suitable construction for receiving a particular lamp. The specific design of the lamp holder 116 may vary as determined by the lamp 301 and the base configuration thereof.

A socket mounting plate 116A is attached to the end of the lamp holder 116 by any suitable means such as rivets, screws, adhesives or the like. The holder 116 and the plate 116A may be integrally formed in some instances.

The socket mounting plate 116A is attached to an end cap 117 by screws 117A or the like which are threadedly engaged with the standoffs 119. The standoffs 119 provide ventilation space 310 intermediate the plate 116A and the end cap 117 so that air can flow between the plate and the end cap. The end cap 117 includes at least one aperture 150 therethrough to provide a path for air flow therethrough as suggested by arrow 302.

As will be seen, socket mounting plate 116A also acts as a light leak shield to prevent unwanted light leak out of the ventilation space 310 from the lamp contained in assembly 108.

An outer housing 120 which is, typically, an extruded aluminum (or similar material) tube is joined to the end cap 117 by swaging, rivets or the like. The housing 120 includes at least one screw channel 130 (see FIG. 2A) on the internal surface thereof.

A circular collar 124 is joined to housing 120. The collar 124 includes a first cylindrical portion 124A which fits within the housing 120 and a second cylindrical portion 124B connected to the first cylindrical portion by a flange or shoulder 123. The outer surface of the second cylindrical portion 124B of collar 124 is threaded to engage the threads on the inner surface of the glare shield 101.

As seen in FIG. 1, air intake is permitted through the openings 325 formed between the housing 120 and the collar 124, such that air is free to pass as suggested by arrow 303.

Thus, air entering through intake vents 325, circulates through the open interior of housing 120 (and around the lamp in lamp 301 holder 116), around and through the space 310 between the mounting plate 116A and the end cap 117, and, finally, out through the apertures 150 in the end cap 117 as suggested by arrows 302 and 303.

The lamp 301 is contained, basically, within the glare shield 101 which prevents radiant light therethrough. As well, any "stray" light at the bottom end of the glare shield 101 is contained within the collar 124 and housing 120. The "stray" light, if any, does not pass through the opening 325 because of the relationship of the components.

Likewise, any reflected "stray" light is contained by the socket plate base 116A and the end plate 117. Because of the spacing of these components and the arrangement and alignment of any apertures therein, stray light is prevented from exiting the inner portion of the instant fixture at the inner end thereof.

Figure 2A:
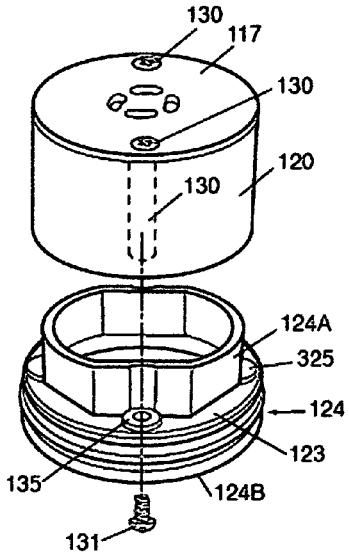
FIG. 2A is an exploded view of the socket assembly shown in FIG. 1 with an air intake and venting structure therein.
Figure 2B:
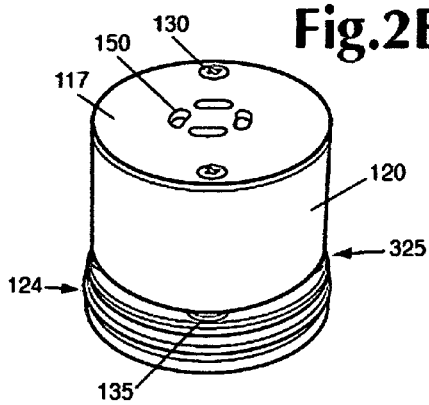
FIG. 2B is an oblique view of the assembled socket assembly shown in FIG. 2A.

As seen best in the exploded view of FIG. 2A, the cylinder 120 of socket assembly 108 is joined to intermediate collar 124 by screws 131 which pass through apertures in standoffs 135 in shoulder 123. Typically, the standoffs 135 at screw channels 130 and apertures 325 are disposed in quadrature around the housing 120 and collar 124, The apertures or vent slots 325 (see also FIG. 2B) between the collar 124 and the cup 120 to create convection cooling at the lamp base 116 as suggested by arrows 302 and 303.

Openings through the shoulder 123 in the collar 124 are disposed in relation to the screw channels 130 in the housing 120 so that screws 131 can join these components together.

Referring now to FIG. 3 there is shown an exploded view of the fixture system 100 of the instant invention.

The system 100 comprises a glare shield 101 which is, typically, fabricated of spun or extruded aluminum but is not limited thereto. The shield 101 is a hollow, substantially cylindrical shaped body 102 with ends 103 and 104. (However, the body 102 can be cone shaped 104 or any other suitable shape.) The outer end 103 of the shield 101 is also configured to provide a glare shield for a light source mounted therein (see FIG. 1) and, typically, has a number of internal grooves 103A to receive optional filters and louvers or the like.

The inner surface of end 104 of the glare shield 101 is, typically, threaded 125 to receive the threaded end 124B of collar 124 of socket cup assembly 108. The threads can be integrally formed in the interior of the shield 101 or by insertion of the threaded collar 125.

The body 102 is adapted to receive the reflector 110 and the glass lens 111. The lens 111 may be integrally joined to the reflector 110, or simply held in place as a stacked assembly with a spring clip 113. The lens 111 is, typically, a spot or flood-type lens which is made of a precision machine molded clear hard glass with a dimpled dome surface.

The reflector 110 is, typically, precision formed, polished and brightly anodized aluminum, or metalized glass. The reflector 110 is mounted within the glare shield. The reflector may be permanently adhered to the interior surface of shield 101 or attached to the end cap enclosure cup 112 to form a one-piece installation. Alternatively, the reflector 110 and related mounting components can be removable for field installation or replacement.

A separate precision parabolic reflector assembly can be fabricated of reflector housing 101 with a reflector 110 attached to and contained therein. The glare shield or reflector housing 101 extends outwardly beyond the reflector 110 with a series of grooves 103A on the inner surface thereof to hold optional lens variations 111, color filters 114, louvers and the like.

A number of optional elements can be installed by moving circular retention spring wire 113 to different settings in the grooves 103A to accept the various optional elements.

An optional element holder 412 (see FIG. 4B) can be produced as a separate part that is placed in the outer end 103 of the glare shield. The separate holder 412 is, typically, fabricated of spun aluminum which can have a matte black or other suitable color powder coat thereon, injection molded thermo plastic or other suitable component. The element holder fits snugly into the end of the glare shield 102 and is retained by a suitable friction fit, adhesive, spring clips 481, or the like.

Typically, element holder 412 has a plurality of concentric steps, typically, three in number which can accept and retain a circular spring-loaded retention ring 113 which maintains optional operational elements in the end of glare shield 102.

The operational elements can comprise a filter 114, such as color or light filters. Alternatively, the operational elements can comprise louvers, such as a cross-hair louver to affect the light beam and to further reduce glare from the light source, or the like, which are not shown.

In addition, an optional pole-changer set screw 118 can be included in the side of shield 101. The set screw 118 is tightened against the socket assembly threads 124B of collar 124 so that the glare shield 101 does not rotate and inadvertently disengage from the socket assembly 108 during removal of the system 100 by, for example, use of a pole changer, in down light applications.

In operation to replace a burned out lamp, merely unscrew the glare shield 101 which is threadedly attached to the collar 124 of the cup assembly 108 and remove/replace the lamp in lamp holder 116.

The entire assembly when engaged with a coupling to socket assembly 108 allows for the exact orientation of the arch-tube light source 301 and reflector 109. Because the base of the lamp is housed within the structure thereof, variation in length and or structure within the socket assembly 108, is the sole factor in positioning the arch-tube and reflector for proper orientation.

Figure 4:
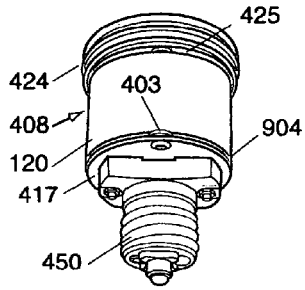
FIG. 4 is a view of a screw-in embodiment of the instant invention socket assembly as shown in FIG. 2B.

FIG. 4 illustrates a socket assembly 408 with an Edison screw base 450 attached to end plate 417 of the housing 120 similar to socket assembly 108 described supra.

In this embodiment, the socket mounting plate 116A may be eliminated, and the lamp socket 116 is mounted directly to the end cap 417. Inasmuch, as an Edison based screw shell is attached to the center of the end plate 417, the center ventilation aperture 450 may be precluded. In this case, ventilation is achieved by hot air being exhausted through the space 904 or by using a spacer 403 between the housing 120 and the mounting plate 417.

Alternatively, vent holes can be incorporated in the end plate itself. Air enters through slots 425 between the threaded collar 424 and the housing 120. Hot air is exhausted through the vent slots 904. Thus, air cooling of the socket assembly 408 is still achieved. However, this design could have some light leak.

Figure 4B:
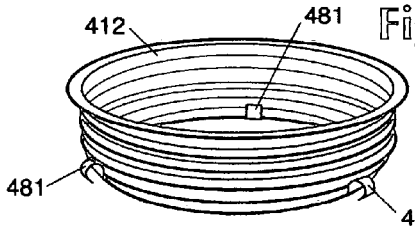
FIG. 4B is a view of the separate insertable grooved element holder as alternate construction to machining grooves as shown in FIG. 3
Figure 4A:
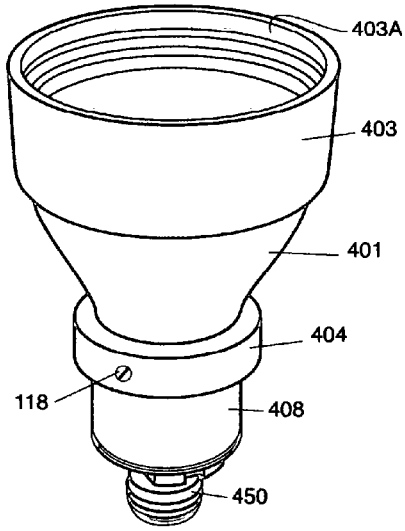
FIG. 4A is an oblique view of the embodiment of the invention shown in FIG. 4 with one variation of an optical chamber installed.

As shown in FIG. 4A, it is understood that the socket assembly 408 shown in FIG. 4 can be threadedly attached to a reflector assembly 401 as described supra. Again, an optional set screw 118 can be used to secure the collars 404 of the reflector assembly 401 to the socket assembly 408 as described supra.

For illustrative purposes, the lighting system shown in FIG. 4A includes a conical shaped reflector 401 which is similar to reflector assembly shown in FIG. 3 in all respects other than shape. That is, the glare shield 401 has a threaded end 404 which engages the collar 424 (see FIG. 4) and the other components discussed supra relative to FIG. 3. Thus, the socket assembly and glare shield components are, largely, interchangeable.

FIG. 4B is a showing of the separable element holder 412 which can be inserted into the outer end 403 of glare shield 401 (or 101). The element holder 412 includes a plurality of grooves for retaining the optional lenses and the like. A plurality of spring clips 481 are attached to one end of the element holder to engage the interior surface of the glare shield.

This design is suitable for new construction fixtures, but is equally adaptable for retrofit application when used in installation in existing metal halide lighting fixtures that are fitted with standard, Edison based metal halide PAR lamps. Since the existing fixture already has ballast, simply unscrewing the existing PAR lamp, and screw-in the assembly 408. Longer lamp life will thereby be achieved along with all the other advantage that has previously been outlined.

Keeping in mind the exceptions noted above, with regard to the socket assembly designs described, all other optional adaptations are compatible and are common one to another in each application for use in track, down light, surface mount, pendant mount and the like, as described herein to which all claims apply.

Since it is critical that the lamp arch-tube is positioned properly within the reflector and the lamps vary in length, all adjustment in the proper orientation of the arch-tube relative to the reflector is done by specific cut lengths of the aluminum extrusion that form the socket housing, by specific length die-cast socket housings, or, alternatively, by spacers or standoffs within the socket assembly to adjust the position of the lamp within the reflector assembly.

Unique bracket designs that are appropriate for most end use applications of the light fixture that will be used in down lights, track lights, and the like. Each type of bracket is designed to not only permit the light to be rotated, directed, and/or elevated, but will facilitate the specific manner in which the socket receives electricity, and how the supply wires will be routed or attached to a given fixture type. In most cases, it is important to note that the brackets are attached to the socket assembly cup and all routing of wires takes place within that unitized structure. Thus, the lighting chamber is totally separate thereby making it possible to unscrew the optical system from the electrified socket assembly.

Figure 5:
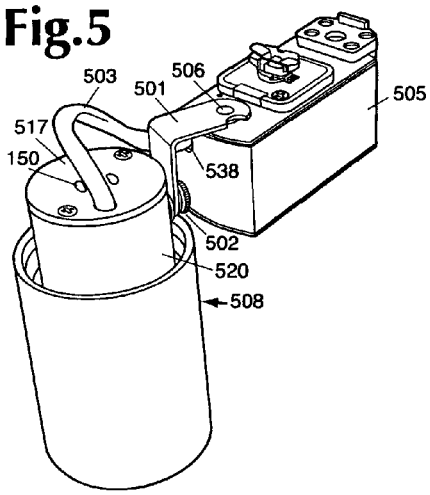
FIG. 5 is an oblique view of one embodiment of an "L" bracket attachment for supporting a track light fixture according to the instant invention.

FIG. 5 illustrates a low profile track mounted fixture. One end of the L-shaped bracket 501 is attached to the socket housing 520 of the assembly by screw-knob 502, rivets or the like. This L-shaped bracket design allows for vertical up and down aiming of the socket housing. The other end of the L-shaped bracket attaches to the top of the fixture 505 via a single pivot point 506 and provides side-to-side rotational aiming.

Wires 503 may be routed out the side or back of the socket assembly through the cover plate enclosure. The wires are, preferably, enclosed in sleeving, pass through aperture 538 and terminate in the ballast housing 505.

Cross-reference is made to co-pending design patent application Ser. No. 29/262,335, filed on Jun. 30, 2006 by the common applicant.

Figure 6:
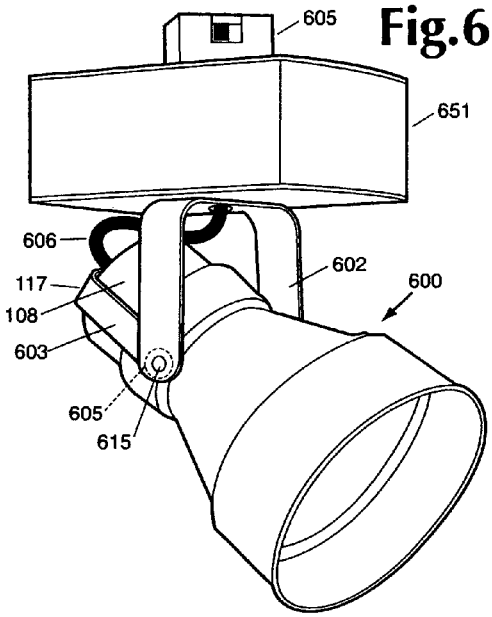
FIG. 6 is a view of a "swing-set" mounting bracket with a track fixture attached thereto.

FIG. 6 illustrates a fixture 600 for use with a track-light system. the fixture utilizes a support bracket apparatus which comprises mating U-shaped brackets 601 and 603 which are referred to as a "swing set" bracket. The two "U" brackets, one smaller than the other, are attached at the respective open ends 602 and 603 and attaching with suitable fasteners 615, rivets or the like. A spring washer 605 (shown dashed) is part of the assembly to provide tension to hold the brackets (and fixture) in place once adjusted. The outer cross member of bracket 602 is attached to a face plate of the ballast housing 651. The attachment can be permanent, as shown in FIG. 6, by rivets, spot welding or the like. A removable attachment device is also contemplated. The inner bracket 602 is attached to the end plate 117 by any suitable means on the socket assembly (see FIG. 1), thus allowing vertical up and down aiming.

Rotational aiming is achieved via the rotational track block 605 mounted on top of the fixture ballast housing 651. Sleeved socket wires 606 exit the socket housing 108 and terminate in the ballast housing 615. Enough slack in the wires is provided so that full swinging of the fixture is allowed during aiming. This type of bracket/pivot mounting can be used on the track fixture as illustrated in FIG. 6, but is also suitable for surface or recessed fixtures as discussed infra.

Figure 7:
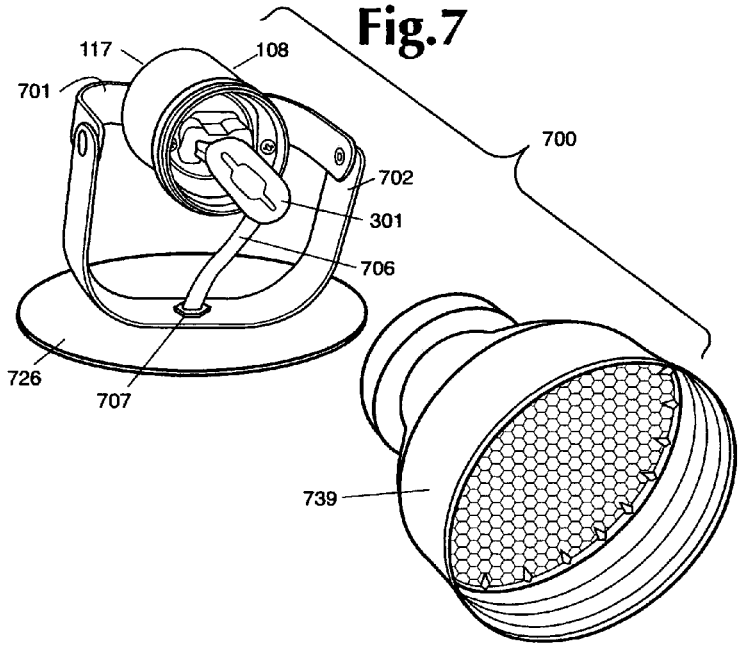
FIG. 7 is an exploded view of a "swing-set" mounting bracket with a surface mountable bracket to suspend the fixture.

FIG. 7 shows an alternative construction using the "swing set" bracket as shown in light fixture configuration 700. In this embodiment, the socket wires 706 exit the socket assembly cup 108 and are again routed through a hole in the center of the larger (outer) bracket 702. In this embodiment, the bracket 702 is mounted to plate 726 by nipple 707 to accept wires 706. The end plate 117 of socket assembly 108 is attached to the smaller or inner bracket 701. The "swing set" bracket permits adjustment in all directions, rotational, as well as back and forth motion in order to point the glare shield 739 of fixture 700 in the desired direction. This arrangement permits the light fixture 700 to be mounted in many locations and configurations.

Of course, an alternative design for the light fixture 700 which can be utilized attached to the socket assembly 108 as shown in FIG. 3.

Figure 8:
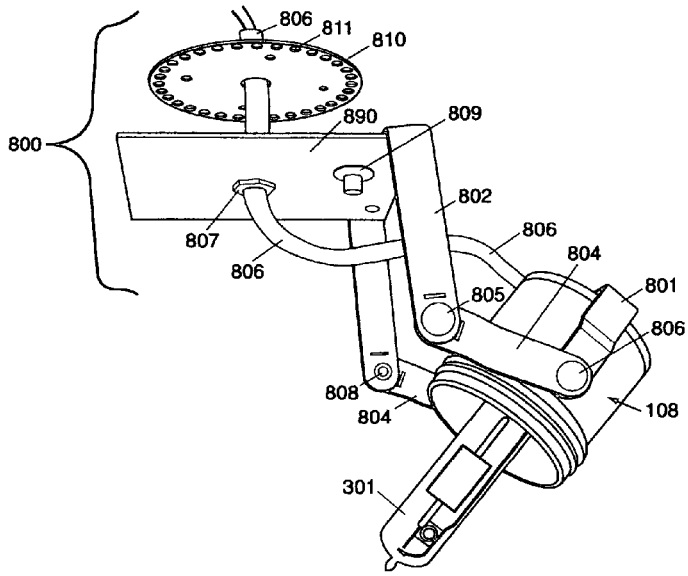
FIG. 8 is a view of a "praying mantis" three element hinged support bracket with a socket cup assembly shown in FIG. 1 attached thereto.

FIG. 8 shows a lighting system 800 which includes another bracket design that is used primarily in, but not limited to, recessed down light applications.

The bracket shown in FIG. 8, referred to as a "praying mantis" adjustment bracket, is shown with the socket assembly 108 attached thereto. The optic chamber is removed for simplicity.

An outer U-shaped mounting bracket 802 is attached to a base mounting plate 890, typically adjacent one end thereof in any suitable fashion such as welding, rivets or the like. Wires 806, from the socket cup assembly 108, are routed through apertures in base plate 890. A nipple 807 can be used to pivot and attach the assembly to the fixture housing.

The closed end of a smaller "U-shaped" bracket 801 is attached to the socket assembly 108. Two extension arms 804 have the opposite end thereof attached to the open ends of the "U" bracket 801 and 802. Four attachments points link the two "U" brackets and two extension arms together using rivets, screws or the like with spring washers. (Only three of the attachment points, viz. points 805, 806 and 808 are visible in FIG. 8.) Hence, a very unique mounting bracket is created that has almost endless adjustment possibilities.

It should be understood that additional extension arms can be included intermediate the U-shaped brackets shown and discussed infra.

In one embodiment, the bracket mounting base plate 890 with a center mount is designed to be installed on the top inner surface of recessed down lights. A spring loaded ball tension member 809 is mounted to the "U" bracket mounting base plate 890. In particular, a "clicker" plate 810 having a concentric pattern of small holes 811 is attached to the top surface of the fixture.

The spring loaded ball 809 and the "U" bracket mounting plate on which the spring loaded member is attached align and index with the holes 811 in plate 810. The tension for the spring loaded ball moving of the holes in plate 810 as the "praying mantis" bracket is rotated creates a "clicking" sound as the ball snaps partially into one hole and skips to the next hole in the pattern as the bracket is rotated. The spring tension for this unique adaptation holds the bracket and fixture in the desired aiming of any rotation within approximately a 350 degree rotation in any direction.

Figure 9A:
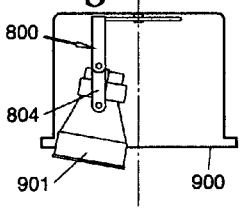
FIGS. 9A through 9D are several representative aiming positions of the support bracket shown in FIG. 8 with a single lamp down light.
Figure 9B:
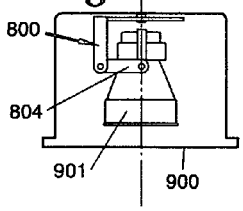
Figure 9C:
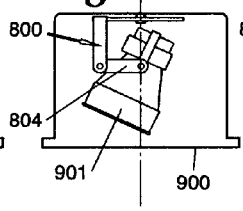
Figure 9D:
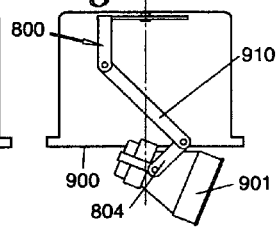

Referring concurrently now to FIGS. 9A-9D, it is seen how the adjustment bracket 800 is used in down light cans or boxes 900 to position the lighting element 901 (shown with a representative conical glare shield) into a totally recessed position (FIG. 9B) positioned on either side of the recess box 900 (FIG. 9A). The segmented adjustment arms can reach, extend and rotate to create virtually any aiming angle desired, from a very deep aiming angle (FIG. 9C) to extend past the ceiling plane in a specific arrangement shown in FIG. 9D and is referred to as "cobra head." This configuration uses a second set of extension arms 910 intermediate the bracket 800 and the extension arms 804 to, typically, permit the "cobra head" apparatus to reach out of the recessed fixture box in order to point the light source where desired.

Figure 10:
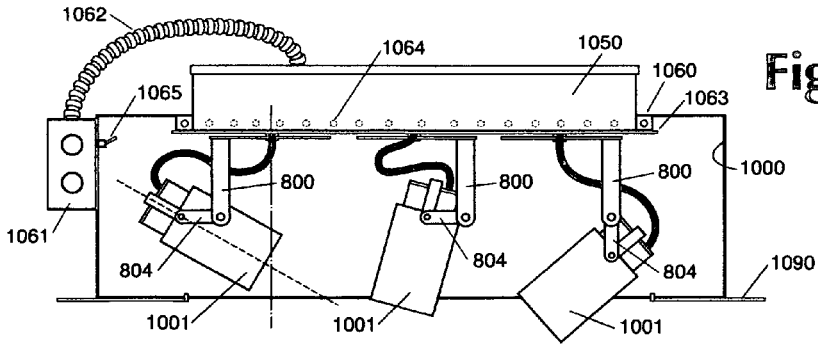
FIG. 10 is a view of a plurality of support bracket units used in a multiple fixture application with an internally mounted control switch.

This design can be used as a single light fixture assembly in a single recessed fixture box or round fixture can as illustrated in FIGS. 9A-9D. Conversely, individual lights or a number of fixtures can be installed in larger linear recessed box 1001 that accommodates multiple light fixtures, as shown in FIG. 10

In this embodiment, a plurality of light fixtures 1001 (with representative cylindrical glare shields) are mounted in different positions and angles within a single recessed ceiling box 1000. Enclosure 1050 is removably attached to box 1000 by fasteners 1060 inside the fixture housing 1000. Enclosure 1050 can be a ballast box, splice box, wire way or any combination thereof. Alternatively, a ballast can be mounted in a conventional J-Box, external to the box. Input electrical wires from a suitable J-Box 1061 run through a length of conduit 1062. The conduit is long enough to allow the enclosure assembly 1050 to drop down out of the fixture box 1000 after releasing the fasteners 1060, and be suspended below the ceiling line 1090 in order to service the ballast attached thereto.

The clicker disc 810 (see FIG. 8) can be attached to a light leak shield mounting plate 1063 that is attached to the underside of the enclosure 1050.

Likewise, the adjustable mounting assembly 800 can be attached to the mounting plate 1063 which is larger than the outer dimensions of the enclosure 1050, and, thus, shields unwanted radiant light that may be present in the plenum of endosure 1050 above the fixtures 1001 from entering through ventilation holes 1064 in the enclosure 1050.

As a safety feature, most electronic ballasts that operate Metal Halide lamps are programmed to shut down when the CMH lamp reaches end of life. In order to reprogram the ballast, power to the ballast must be turned off for a few seconds. That is, only by interrupting the electrical power to the ballast will the ballast reenergize and operate the new replacement lamp. Typically, the process for resetting the ballast is turning off the power at the wall switch or electrical panel (except in some track light assemblies where the fixture is easily removable from the track and resetting the ballast occurs when the fixture is reinstalled in the track).

In down light applications as described herein, the only way to reset the electronic ballast is to turn off the power as described above, a process that is often inconvenient and time consuming. Therefore, the instant invention incorporates an on/off switch 1065, typically mounted within the interior of the recessed box 1000. The switch 1065 is, preferably, adjacent to the J-Box 1061 or the ballast/wire way enclosure 1050 so that all necessary splices are contained within those respective enclosures. Thus, a single fixture 1001 or fixture housing 1000 can be controlled rather than deactivating an entire circuit as is done currently.

Thus, there is shown and described a unique design for a light fixture with lamp cooling capabilities and stray light control, a detachable lighting optical chamber with functional options contained therein, and unique mounting brackets, designed for specific applications of the light fixture.

While the description contained herein is directed to particular embodiments, it is understood that those skilled in the art may conceive modifications and/or variations to the specific embodiments shown and described herein. Any such modifications or variations which are within the purview of this description are intended to be included therein as well. It is understood that the description herein is intended to be illustrative only and is not intended to be limitative. Rather, the scope of the invention described herein is limited only by the claims appended hereto.

The invention claimed is:

1. A light fixture comprising,
a glare shield,
a reflector mounted within said glare shield,
a lens mounted to said reflector, and
a socket assembly mounted to one end of said glare shield in order to permit air flow through said socket while preventing light radiation therefrom.

2. The fixture recited in claim 1 including,
lamp mounting means mounted to said socket assembly.

3. The fixture recited in claim 1 including,
said reflector and said lens are mounted to said glare shield.

4. The fixture recited in claim 3 wherein,
said reflector and said lens are integrally formed.

5. The fixture recited in claim 1 wherein,
said socket assembly is threadedly mounted to said one end of said glare shield.

6. The fixture recited in claim 1 including,
an element holder disposed at a second end of said glare shield adjacent to said lens.

7. The fixture recited in claim 6 wherein,
said element holder is selectively detachable from said glare shield.

8. The fixture recited in claim 6 including,
at least one lens louver or a filter are mounted in said element holder.

9. The fixture recited in claim 8 including,
a retention ring mounted in said element holder to retain said elements or said filter within said element holder.

10. The fixture recited in claim 6 wherein,
said element holder comprises at least one groove machined into the inner surface of said glare shield.

11. The fixture recited in claim 1 including,
an electronic ballast connected to said socket assembly.

12. The fixture recited in claim 11 including,
housing means for enclosing said electronic ballast.

13. The fixture recited in claim 12 including,
switch means mounted to said housing means for selectively deactivating said electronic ballast.

14. The fixture recited in claim 1 wherein, said reflector comprises a precision-formed aluminum or glass unit with a reflective inner surface.

15. The light fixture recited in claim 1 wherein, said-socket assembly comprises, a cylinder housing, an end cap attached to enclose one end of said housing, at least one ventilation hole provided through said end cap, a socket mounting plate which is slightly smaller than the interior diameter of the socket housing to allow air to pass around the perimeter of the socket mounting plate, and, a lamp socket mounted to the socket mounting plate wherein light radiating from a lamp contained in the socket cup is shielded from the ventilation hole by said mounting plate.

16. The light fixture recited in claim 15 wherein, said cylinder housing is die cast aluminum.

17. The light fixture recited in claim 15 including, at least one stand-off provided on the inner surface of said end cap.

18. The fixture recited in claim 1 including, locking means for selectively locking said socket assembly and said glare shield together.

* * * * *